United States Patent [19]

Otani

[11] 4,074,749

[45] Feb. 21, 1978

[54] CASTING MACHINE WITH MOLD TILTING DISCHARGE MEANS

[75] Inventor: Akira Otani, Kobubunji, Japan

[73] Assignee: Tanabe Kokoki Co., Ltd., Itoigawa, Japan

[21] Appl. No.: 759,098

[22] Filed: Jan. 13, 1977

Related U.S. Application Data

[63] Continuation of Ser. No. 695,136, June 11, 1976, abandoned.

[30] Foreign Application Priority Data

June 13, 1975 Japan ..... 50-71566

[51] Int. Cl.[2] ..... B22D 5/02; B22D 29/00

[52] U.S. Cl. ..... 164/326; 164/323; 164/344

[58] Field of Search ..... 164/323, 324, 325, 326, 164/329, 331, 344, 404, 405, 409, 401, 402, 131; 425/439

[56] References Cited

U.S. PATENT DOCUMENTS

| | | | |
|---|---|---|---|
| 486,809 | 11/1892 | McCaslin | 164/329 X |
| 714,818 | 12/1902 | Orth | 164/323 X |
| 760,523 | 5/1904 | Crossley | 164/326 |
| 3,964,542 | 6/1976 | Skurko | 164/329 |

*Primary Examiner*—Robert D. Baldwin

*Attorney, Agent, or Firm*—Thompson, Birch, Gauthier & Samuels

[57] ABSTRACT

Disclosed is a casting machine which includes a truck driven horizontally in an advancing direction. A plurality of molds are carried on the truck. The molds are aligned in the advancing direction and are rotatable about axes extending perpendicular to the advancing direction. Each mold has a rearwardly extending lip which overlaps the forward edge of the next succeeding mold when the molds are horizontally arranged. Arms are connected to each of the molds for rotation therewith. The arms have wheels thereon which cooperate with guides adjacent to the path of travel of the truck in the advancing direction to control the rotational attitude of the molds. The aforesaid guides have horizontal sections which maintain the molds in a horizontal attitude, and curved sections which rotate the molds about their respective axes in order to discharge the contents thereof at a casting discharge position.

10 Claims, 10 Drawing Figures

CASTING MACHINE WITH MOLD TILTING DISCHARGE MEANS

This is a continuation of application Ser. No. 695,136 filed June 11, 1976 now abandoned.

This invention relates to a casting machine of the type wherein molds are horizontally carried, and more particularly to a castings discharge device for use in this casting machine.

An example of known prior art casting machines is the type wherein an endless chain, carrying a series of parallel cast-iron molds with overlapping edges, passes over a head and a tail sprocket wheel; and molten metal is poured into the molds near the tail sprocket, solidifies, and is cooled by water sprays as the chain rises to the head sprocket, and falls from the molds into cars as the chain passes over the head sprocket. This machine must work against gravity since it carries the mold and the cast metal upwardly, and therefore has the disadvantage that the power consumption is large.

Further, in a horizontally carrying type prior art casting machine, the cast metal is discharged by separately providing a tilting means with a motor-driven unit and/or a fluid pressure-piston cylinder unit and tilting the mold or the truck at right angles to its advancing direction. In this discharge system the advancing direction of the mold intersects the tilting direction thereof and it becomes necessary to space molds apart from each other, which, however, in cases where the molten metal pouring is continuously carried out, requires the provision of a molten metal leak-preventing member between the molds. In this case, however, the molten metal sticks to the member and it is troublesome to remove the stuck metal, which results in an additional disadvantage that the product yield of the cast metal is decreased.

Indeed, the molten metal leak can be prevented by providing the molds with overlapping edges, but because of the cast metal being discharged at right angles to the advancing direction of the mold it becomes necessary to shift the molds to set free the overlapping edges, which necessitates the additional provision of another power source for mold-tilting.

A first object of the invention is to provide a casting machine eliminating the necessity of providing a particular power source for mold-tilting.

A second object of the invention is to provide a casting machine capable of preventing the mold from being scooped out or consequently cracked due to one point-impact of molten metal against an empty mold upon the molten metal being initially poured into this mold.

The first object has been achieved, in a rotary table type- or rectilinearly driven type-casting machine, by forwardly tilting a mold at a castings discharge position through a prescribed angle beyond the vertical line through utilizing the driving force of a truck driving means. For executing this operation, a pair of trunnions are allowed to project from both lateral sides of the mold having an overlapping edge or lip at the backward end as viewed with respect to the advancing direction of the mold, the common central axis of said trunnions being in alignment with a straight line which is included in a horizontal plane including therein the center of gravity of the mold when the mold is charged with the molten metal and which passes through said center of gravity or through a point displaced slightly forwardly of this center of gravity, perpendicularly to the advancing direction of the mold. On one trunnion-side opposite to the driving means-side with respect to the rotary table, and in case of the rectilinearly driven type casting machine, on one trunnion-side at which a mold tilting device as later described is provided, said one trunnion is further projected, and an arm having a prescribed length smaller than the mold length is fixed to this projected end portion of the trunnion, and a pair of stub shafts extending horizontally and perpendicularly to the advancing direction of the mold are respectively allowed to project at both ends of the arm, and a pair of rollers are rotatably supported on the pair of stub shafts, respectively. The pair of trunnions are rotatably supported, respectively, on a pair of trunnion bearings secured to the truck. Longitudinally extending guide rails for guiding the rollers are supported by columnar supports provided on a floor. The guide rails are interrupted by a set of curved guide plates of the mold tilting device as later described. Hereinafter, one side-guide rail portion situated backwardly of the curved guide plate-set are referred to as first guide rail while the other side-guide rail portion situated forwardly of the curved guide plate-set as a second guide rail. On the ordinary travel section of the guide rail, the rollers are guided to the first guide rail with the arm kept at a horizontal condition, and therefore the mold charged with molten metal at a molten metal pouring section goes on travelling in a state in which the mold is kept horizontal until a castings solidified by natural cooling or water sprays arrives at a castings discharge position.

A castings discharge device or mold tilting device is constructed such that the set of curved, steel sheet-made, roller guide plates are provided on a board or support vertically erected on a floor. That is to say, the curvilinear configuration of the roller guide plate-set is so designed that the entrance of the roller guide plate-set continuously matches with the first guide rail. As the trunnion advances, a forward one of said rollers is by degrees moved downwardly by the guide plate-set to cause the mold to be tilted forwardly until the mold is tilted through a prescribed angle beyond a vertical line. Thus, the castings is dropped and discharged, and subsequently a backward one of said rollers is guided by the guide plate-set to cause the mold to be gradually restored to a horizontal condition. Since the curvilinear configuration of the guide plate-set is so designed that the exit of the guide plate-set continuously matches with the second guide rail, both said forward and backward rollers are guided to the second guide rail.

The second object has been achieved by mounting the castings dicharge device upon another truck so as to permit its advancement and retirement perpendicularly to the mold advancing direction by a fluid pressure-piston cylinder unit and by using a reversible motor as a driving motor for the rotary table. That is to say, even when the mold whose castings discharge is completed as mentioned above is again brought to the molten metal pouring position, it is allowed to pass through the pouring position without being charged with the molten metal, and when the last empty mold has reached the pouring position, the rotary table is stopped and the castings discharge device is retired and then the rotary table is return-travelled and the molten metal is poured into the mold while the mold is being return-travelled. After all the molds have been charged with the molten metal, the return travel of the rotary table is stopped and the castings discharge device is advanced to a prescribed position. Thereafter, the rotary table is normally travelled to effect the discharge of cooled castings. By so doing, upon the return travel of the rotary table, the position at which the poured molten metal initially collides with the mold is made different from the position upon the normal travel of the rotary table. Therefore, such thermal shock given to the mold by pouring high temperature-molten metal is scattered to prevent the mold from being scooped out or consequently cracked. When the mold is return-travelled, a condition wherein no guide rail for the rollers does exist is reached at the castings discharge position. Even under this condition, a moment so acts as to cause the overlapping edge of one mold to be pressed against the backward edge of the immediately preceding mold since the central axis of the trunnion is situated on or slightly displaced from the center of gravity of the mold, so that the arm is kept horizontal.

The return travel of the rotary table of the casting machine can be effected also by retiring not wholly but partially the castings discharge device. The castings discharge device capable of partially retired is as follows. That is to say, a block-like attachment whose underside extends from the upper edge of the entrance portion of a set of forward roller guide plates to a position lower than the same level as the upper surface level of a guide rail portion supporting said rollers is slidably fitted into a hole having the same contour as this attachment, bored in the vertical board perpendicularly to the surface thereof, and an air pressure- or oil pressure-operated device for permitting the attachment to be projected from or retired into the surface of the vertical board is connected to the attachment, and two guide plates are horizontally provided one over the other on the downstream side from the attachment in such a manner that they contact the attachment, and the exit of this guide plate-set is allowed to match with the second guide rail. Where the casting machine is normally travelled, the attachment is allowed to project from the vertical board. Since in this case, the rollers of the arm are guide as mentioned above, the mold is forwardly tilted to effect the castings discharge and then is restored to a horizontal attitude and then escapes from the castings discharge device while being guided by the second guide rail. Where the casting machine is return-travelled, the attachment is retired from the vertical board. Since, in this case, the rollers of the arm are guided by said two guide plates, the mold is passed through the casting machine without being tilted.

The foregoing description referred to the case with the rotary table type-casting machine, but it will be easily understood that the same explanation applies to the rectilinearly driven type-casting machine.

This invention can be more fully understood from the following detailed description when taken in conjunction with the accompanying drawings, in which:

FIGS. 1 and 2 respectively are a plan view and a side view, showing part of a rotary table type casting machine of the invention;

FIGS. 3 and 4 respectively are a plan view and a front view, showing a mold tilting device according to a first embodiment of the invention;

Figure 7:
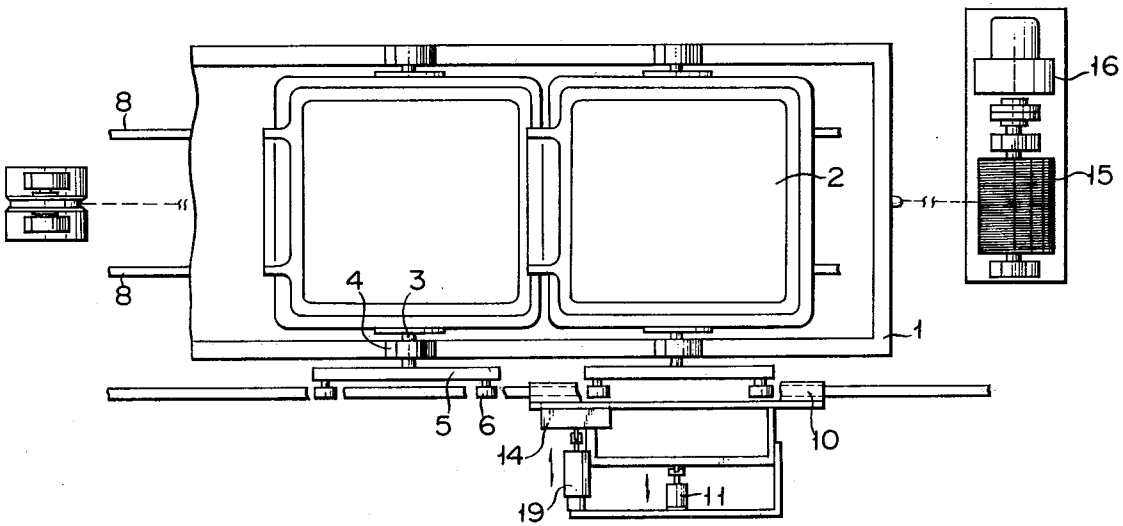
Figure 8:
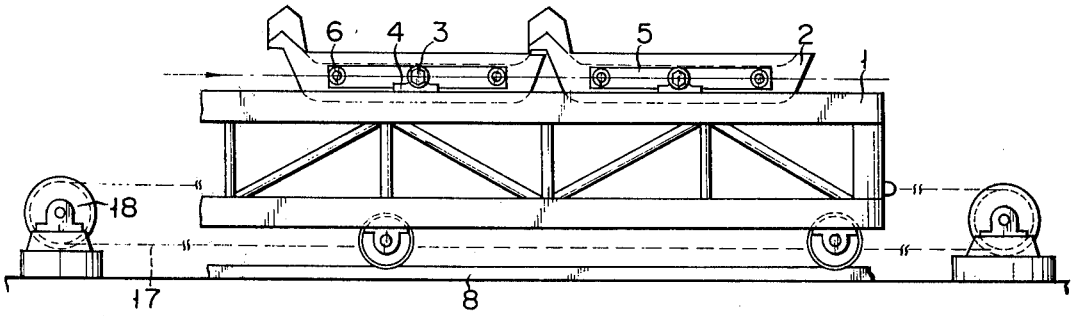
Figure 9:
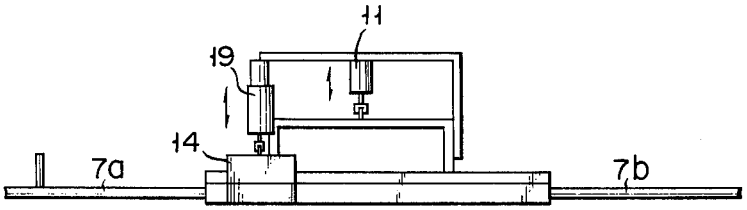
Figure 10:
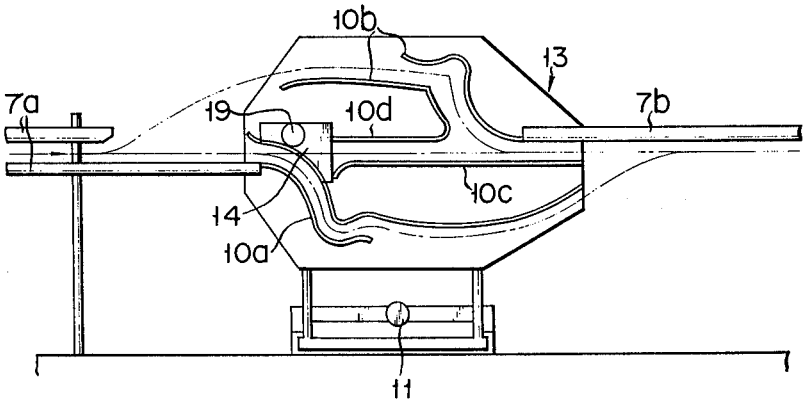

FIGS. 7 and 8 respectively are a plan view and an elevational view, showing part of a rectilinearly driven type casting machine of the invention; and FIGS. 9 and 10 respectively are a plan view and a front view, showing a mold tilting device for use in the rectilinearly driven type casting machine of FIGS. 7 and 8.

This invention will now be explained by describing embodiments of the invention with reference to the appended drawings.

Figure 1:
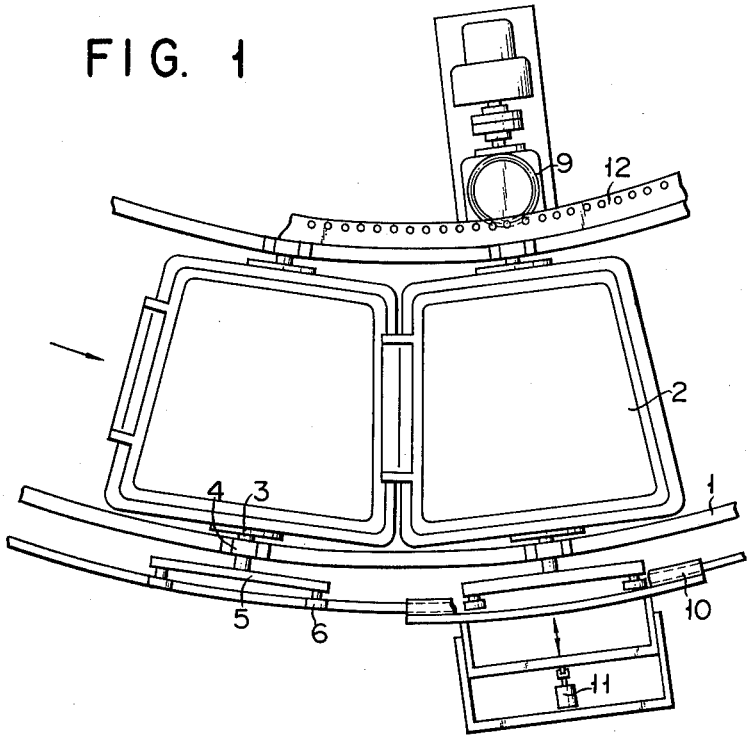
Figure 2:
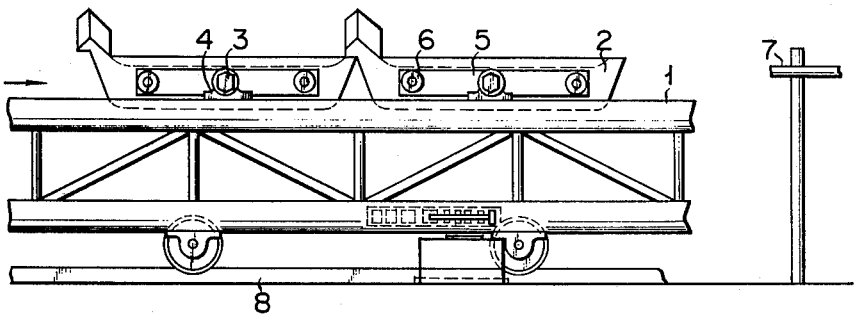

Referring to FIGS. 1 and 2, a casting machine of the invention comprises a rotary truck 1, cast iron-made molds 2 each having an overlapping lip or edge at the rear end as viewed with respect to the advancing direction of the mold, disposed adjacent to each other over the entire surface of the truck, a pair of round steel-made trunnions 3 provided for each mold, and cast iron and brass-made trunnion bearings 4 arranged on the truck at equal intervals. An arm 5 secured to the outer trunnion 3 and a pair of cemented steel-made rollers 6 rotatably attached respectively to both ends of the arm 5 maintain the mold 2 at a horizontal condition in cooperation with longitudinally continuous shape steel-made horizontal guide rails 7 matching with the entrance of a set of guide plates 10 of a mold tilting device for castings discharge.

The truck 1 is made to travel on a pair of rails 8 by driving a pin gear 12 provided on the lower portion of the inner periphery of the truck, through a sprocket wheel 9 with geared motor. The rated horsepower of the geared motor at this time is extremely small since this motor has only to permit the truck horizontally to travel on the rails 8 and does no work against the gravitational force and is low in speed.

Figure 3:
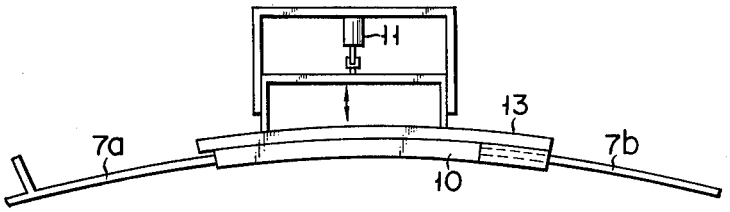
Figure 4:
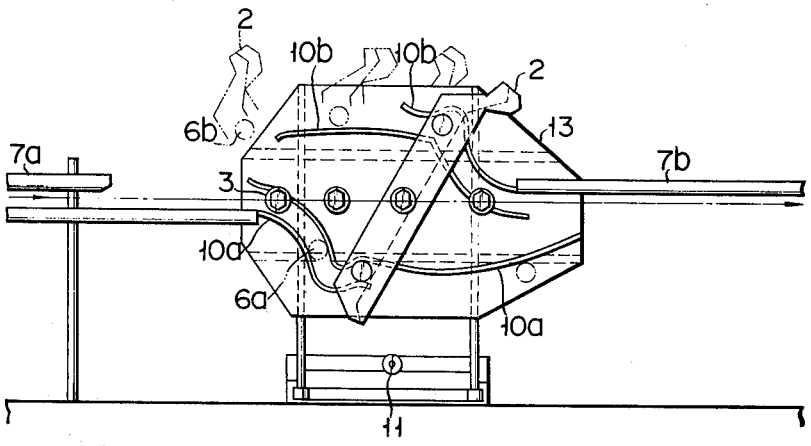
Figure 5:
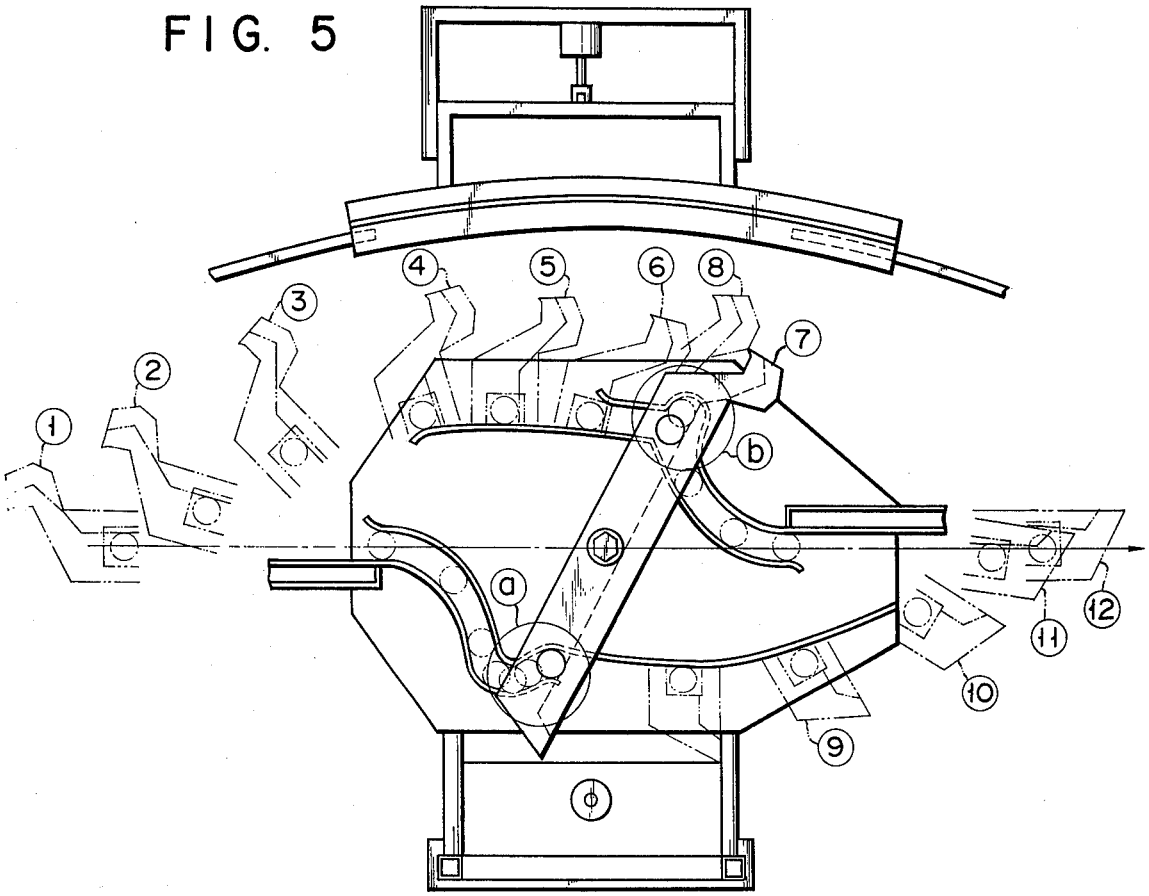
FIG. 5 is a detailed view showing the mold tilting process of the device of FIGS. 3 and 4.

FIGS. 3 and 4 respectively show the configuration of the set of guide plates 10 of the mold tilting device or castings discharge device of the invention and the outline of the mold-tilting process of this mold tilting device. FIG. 5 shows further in detail this mold-tilting process.

As the trunnion 3 advances, a forward roller **6*a* of the pair of rollers 6 attached to the arm 5 guided by a guide rail portion 7*a* is entered into that interspace between a pair of lower guide plates 10*a* of the castings discharge device which matches with the guide rail portion 7*a*, and when the forward roller 6*a* is guided downwardly, the arm 5, accordingly the mold 2 begins to be tilted forwardly. Then, the tilting of the mold 2 sequentially proceeds in accordance with the configuration of the lower guide plates 10*a* as indicated by numerals ①, ②, ③ and ④, and the mold 2 is made vertical at a position ⑤, while the rear roller 6*b* is guided by a lower one of a pair of upper guide plates 10*b*. Next, the forward roller 6*a* receives a resistance and is directionally altered due to the configuration of the lower guide plates 10*a* shown by ⓐ, so that the advancing movement of the forward roller 6*a* is more and more delayed as compared with the advancing movement of the trunnion 3. Consequently, the mold 2 enters the reverse step indicated by numerals ⑥, ⑦ and is forwardly tilted through a maximum tilted angle at a position ⑦. At this position a castings is discharged. When the trunnion 3 passes through that position and still advances, the rear roller 6*b* is guided by portions of the upper guide plates 10*b* shown by ⓑ to receive a resistance and undergo a directional alternation, so that the forward roller 6*a* is guided by the underside of an upper one of the lower guide plates 10*a* and the arm 5, accordingly the mold 2 is restored to a horizontal condition by following the reverse course ⑦, ⑧, ⑨, . . . . ⑫ to the preceding course. Thus, the rollers 6 escape from the upper guide plates 10***b* and are transferred to a guide rail portion 7*b* matching with the exit of the upper guide plates 10*b*. Thereafter, the empty mold continues to advance and again reaches a pouring position, and thereafter the same operation as mentioned above is repeatedly carried out.

Where the casting machine is return-travelled, the castings discharge device is retired by the piston cylinder beforehand, and the mold 2 is permitted to pass through the castings discharge device in a state wherein it is kept horizontal as mentioned above.

Figure 6:
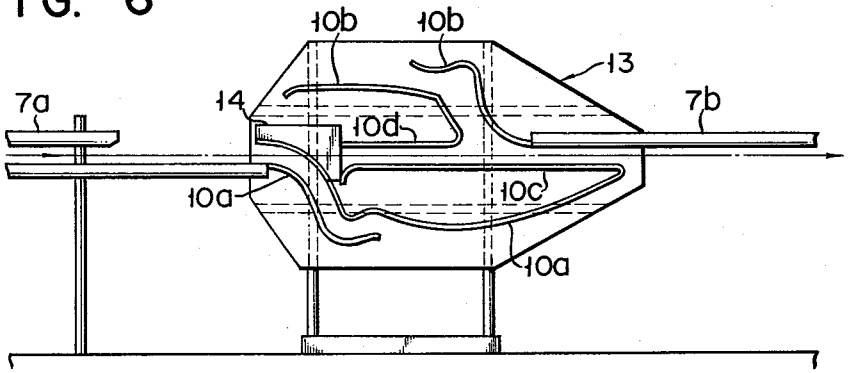
FIG. 6 is a front view of a mold tilting device according to a second embodiment of the invention which permits the return travel of the casting machine by being partially retired.

FIG. 6 is a front view of a mold tilting device according to a second embodiment of the invention which is different from the mold tilting device according to the first embodiment of the invention. By retiring an attachment 14 constituting part of the castings discharge device, the mold is allowed, when the rotary table is return-travelled, to pass through the castings discharge device in a state wherein it is kept horizontal, while by advancing the attachment 14, that is, by allowing the attachment to project from the vertical board 13 the mold is allowed, when the rotary table is normally travelled or advanced, to be forwardly tilted to discharge the castings and restored to a horizontal condition. The projecting and retiring operations of the attachment 14 are carried out by an air pressure- or oil pressure-piston cylinder unit installed onto the vertical board 13 perpendicularly thereto. This mold tilting device is different from that of the first embodiment in the following two respects. The first respect is that this mold tilting device is provided with the attachment which is slidable within a hole bored in the vertical board perpendicularly thereto and beneath which the entrance of a set of forward roller-guide plates is located. The second respect is that in this mold tilting device a set of horizontal guide plates are provided on the vertical board, on the downstream side from the attachment, and in contact with the attachment, and the exit end of said horizontal guide plate-set matches with the guide rail. A detailed description of the mold tilting operation in the advancement of the mold, and of the horizontal attitude maintenance of the mold in the return travel of the mold is omitted since said operation and maintenance are the same as those in the first embodiment.

FIGS. 7 to 10 show a rectilinearly driven type-casting machine of the invention. Reference numerals 1 to 14 denote corresponding parts and sections to those of FIGS. 1 to 6. A rope 17 whose one end is fixed to the forward end of the truck 1 is wound about a truck-tractive drum 15 driven by a geared motor 16 and then is allowed to go round a rope sheave 18 and is fixed at the other end to the backward or rear end of the truck 1. Therefore, as the drum 15 makes a normal rotation and back rotation, the truck 1 is correspondingly moved forwardly and backwardly. The piston cylinder unit 11 so operates as to advance or project and retire the whole of the castings discharge device, while another piston cylinder unit 19 so operates as to advance or project and retire the attachment. In the advancement of the truck 1 the mold tilting is effected by projecting the whole of the castings discharge device and the attachment through operating the piston cylinders 11, 19 respectively. When it is desired to pass the mold 2 through the castings discharge device in a state wherein the mold is kept horizontal, the retirement of only the attachment 14 or the whole castings discharge device has simply be performed alternatively. By so doing, as in the first embodiment, the molten metal pouring into the mold is made possible in both its advancement and retirement, so that the positions at which the molten metal initially collides with the mold to scoop out the same are taken at both the forward and rearward end portions of the mold, which offers an advantage that the life of the mold 2 becomes twice as long as the life of the mold in the prior art case.

While the invention has been disclosed with respect to certain exemplary embodiments, numerous variations are possible within the scope of the invention and it is not intended to limit the same except as defined in the following claims.

What is claimed is:

1. A casting machine comprising:

a truck;

means for driving said truck in an advancing direction;

a plurality of molds carried by said truck, said molds being aligned in the advancing direction and being rotatable about axes extending perpendicular to the advancing direction, each mold having a rearwardly extending lip which overlaps the forward edge of the next succeeding mold when the molds are horizontally arranged;

arms connected to each of said molds for rotation therewith, said arms having first and second guide rollers which in relation to the advancing direction of said truck, are spaced respectively forwardly and rearwardly of the rotational axis of the mold to which the arm is connected; guide means adjacent to the path of travel of said truck in the advancing direction for cooperating with said rollers to control the rotational attitude of said molds, said guide means having horizontal sections which maintain said molds horizontally, and curved sections which rotate said molds about said axes in order to discharge the contents thereof at a casting discharge position, said curved sections including curved upper and lower tracks, said first guide rollers being engageable with said lower tracks and said second guide rollers being engageable with said upper tracks, said curved upper and lower tracks being mounted on a support movable in a direction transverse to the advancing direction of said truck;

and, means for shifting said support between an operative position at which said upper and lower tracks are aligned with the horizontal sections of said guide means, and an inoperative position at which the said upper and lower tracks are not engaged by the rollers on said arms during movement of said truck.

2. A casting machine according to claim 1 further comprising horizontally extending tracks which are located between said upper and lower tracks and which are aligned with the horizontal sections of said guide means when said support is in its operative position, and an attachment mounted on said support for movement between an operative position to engage and guide the first roller of each arm downwardly along said lower track, and an inoperative position allowing said rollers to proceed along said horizontally extending tracks.

3. A casting machine comprising:

a. a truck, b. a truck driving means, c. a large number of adjacent casting molds each of which has an overlapping edge at its backward end as viewed with respect to its advancing direction and has at its both sides, respectively, a pair of trunnions whose common central axis is in alignment with a straight line passing through the center of gravity of the mold when the mold is charged with molten metal or through a point horizontally displaced slightly forwardly of said center of gravity and horizontally extending perpendicular to the advancing direction of the mold and has an arm of a prescribed length secured to one of the trunnions and horizontally extending in the advancing direction of the mold and has a pair of stub shafts projecting from the respective proximities of both ends of the arm and extending parallel to the trunnion and has a pair of rollers rotatably attached to the pair of stub shafts, respectively, d. pairs of trunnion bearings attached onto the truck, for rotatably supporting the pair of trunnions, e. longitudinally continuous guide rails for the pair of rollers, supported by columnar supports provided on a floor and having cut-off or removed portions of a prescribed length at a castings discharge position, and f. a castings discharge device having a set of curved roller guide plates provided at said castings discharge position so as to contact that surface of a vertical board erected on the floor which faces the mold in a manner that the entrance of the guide plate-set continuously matches with the guide rails on the upstream side from the guide plate-set and the exit thereof continuously matches with the guide rails on the downstream side from the guide plate-set, for guiding the pair of rollers so that, as the trunnion of the mold advances, the mold is by degrees tilted forwardly and, after tilted through a prescribed angle beyond a vertical line to the horizontal plane of the castings discharge device, is by degrees restored to an original horizontal condition.

4. A casting machine according to claim 1 wherein said castings discharge device has its vertical board fixed onto another truck and is provided with a fluid pressure-piston cylinder unit for advancing or retiring said another truck at right angles to the advancing direction of the mold.

5. A casting maching according to claim 1 wherein said castings discharge device includes:

a. a block-like attachment whose underside extends from an upper edge of the entrance portion of the guide plate-set to a position lower than the same level as the upper surface of a guide rail portion supporting said rollers and which is slidably fitted into a hole having the same contour as said attachment, bored in the vertical board perpendicularly to the surface thereof, b. A fluid pressure-piston cylinder unit for permitting the attachment to be projected from or retired into the surface of the vertical board, and c. a pair of roller guide plates horizontally provided one over the other on the downstream side from the attachment in a manner that they contact the attachment, and matching, at an exit at the castings discharge device, with said guide rails on the downstream side from the castings discharge device.

6. A casting machine according to claim 1 wherein said truck is an annular rotary table having an intermeshed type driven section at its lower part; and said truck driving means includes a motor, a reduction gear and an intermeshed type driving section.

7. A casting machine according to claim 4 wherein said truck is an annular rotary table having an intermeshed type driven section at its lower part; and said truck driving means includes a reversible motor, a reduction gear and an intermeshed type driving section.

8. A casting machine according to claim 5 wherein said truck is an annular rotary table having an intermeshed type driven section at its lower part; and said truck driving means includes a reversible motor, a reduction gear and an intermeshed type driving section.

9. A casting machine according to claim 4 wherein said truck travels on two parallel straight rails; and said truck driving means is a driving means with a reversible motor.

10. A casting machine according to claim 5 wherein said truck travels on two parallel straight rails; and said truck driving means is a driving means with a reversible motor.

* * * * *